US009050703B2

(12) United States Patent
Nishide

(10) Patent No.: US 9,050,703 B2
(45) Date of Patent: Jun. 9, 2015

(54) GRINDING MACHINE AND GRINDING METHOD

(75) Inventor: Takashi Nishide, Kanagawa (JP)

(73) Assignee: NSK LTD., Tokyo (JP)

( * ) Notice: Subject to any disclaimer, the term of this patent is extended or adjusted under 35 U.S.C. 154(b) by 0 days.

(21) Appl. No.: 14/130,542

(22) PCT Filed: Jun. 22, 2012

(86) PCT No.: PCT/JP2012/066076

§ 371 (c)(1),
(2), (4) Date: Jan. 2, 2014

(87) PCT Pub. No.: WO2013/005590

PCT Pub. Date: Jan. 10, 2013

(65) Prior Publication Data

US 2014/0127972 A1 May 8, 2014

(30) Foreign Application Priority Data

Jul. 4, 2011 (JP) ..... 2011-148538

(51) Int. Cl.

| | |
|---|---|
| ***B24B 49/04*** | (2006.01) |
| ***B24B 51/00*** | (2006.01) |
| ***B24B 33/02*** | (2006.01) |
| ***B24B 49/02*** | (2006.01) |

(52) U.S. Cl.
CPC ..... *B24B 51/00* (2013.01); *B24B 49/02* (2013.01)

(58) Field of Classification Search
USPC ..... 451/5, 8, 9, 10, 11, 51, 52, 61, 180
IPC ..... B24B 49/02,49/04, 49/05, 51/00, 33/02, B24B 5/06, 19/06
See application file for complete search history.

(56) References Cited

U.S. PATENT DOCUMENTS 2,963,829 A * 12/1960 Werth ..... 451/143
3,156,075 A * 11/1964 Slayman ..... 451/8
4,048,764 A * 9/1977 Schmitz ..... 451/9

(Continued)

FOREIGN PATENT DOCUMENTS

JP 6-262498 A 9/1994
JP 2000-94279 A 4/2000

(Continued)

OTHER PUBLICATIONS

International Search Report, dated Jul. 31, 2012, issued by the International Searching Authority in counterpart International Application No. PCT/JP2012/066076.

*Primary Examiner* — Eileen Morgan
(74) *Attorney, Agent, or Firm* — Sughrue Mion, PLLC

(57) ABSTRACT

With the center position CP of a support shaft 6 supporting a grinding wheel 4 being a reference, a provisional grinding start position S0' for a first workpiece 2 is calculated, based on a diameter ID of the first workpiece 2 before grinding, a diameter WD of the grinding wheel, a grinding completion position S4 on the first workpiece after the grinding, and an actual grinding start position S0 of the grinding wheel before grinding in second and subsequent grinding. S0 is determined by performing the grinding by moving the grinding wheel from S0' and by moving the grinding wheel away from the first workpiece by a distance corresponding to S4 near the grinding completion position S4. S0' is set by a calculation, S0'=ID−WD−S4−Sα, considering an allowance Sα between S0 and S0'.

8 Claims, 5 Drawing Sheets

(56) References Cited

U.S. PATENT DOCUMENTS

| | | | | |
|---|---|---|---|---|
| 5,562,526 | A * | 10/1996 | Yoneda et al. | 451/9 |
| 2011/0097971 | A1* | 4/2011 | Kumeno et al. | 451/5 |
| 2012/0028543 | A1* | 2/2012 | Tano et al. | 451/5 |
| 2014/0148081 | A1* | 5/2014 | Nishide et al. | 451/5 |

FOREIGN PATENT DOCUMENTS

| | | | |
|---|---|---|---|
| JP | 2004-17194 | A | 1/2004 |
| JP | 2009-184063 | A | 8/2009 |
| JP | 2010-76005 | A | 4/2010 |
| JP | 2011-45940 | A | 3/2011 |

* cited by examiner

GRINDING MACHINE AND GRINDING METHOD

TECHNICAL FIELD

The present invention relates to a grinding technique.

BACKGROUND ART

Conventionally, in a process of manufacturing various kinds of workpiece, such as a bearing ring (inner ring, outer ring), grinding on an inner diameter portion of a workpiece (e.g., inner ring) or grinding on a raceway groove of another workpiece (e.g., outer ring) is performed. Various proposals have been made in connection with such a grinding technique (see, e.g., Patent Document 1).

According to a conventional grinding technique, when setting a positional relationship between a grinding wheel and a workpiece at the time of, for example, switching workpiece settings, the workpiece is set on a spindle, and then a teaching operation is performed in which an infeed shaft is manually operated to bring the grinding wheel provided on the infeed shaft into contact with the workpiece. For example, the teaching operation with respect to the inner ring includes a manual operation of the infeed shaft to a position where the grinding wheel abuts (contacts) an inner diameter surface of the inner ring. Further, the teaching operation with respect to the outer ring includes a manual operation of the infeed shaft to a position where the grinding wheel abuts (contacts) the raceway groove of the outer ring.

PRIOR ART DOCUMENT

Patent Document

Patent Document 1: JP 2010-076005 A

SUMMARY OF INVENTION

Problem to be Solved by Invention

However, the teaching operation (contacting operation) described above requires an experience, and workers engaging in the teaching operation are required to have high skill. Depending on an experience level of the worker, the teaching operation may take time, and the time required to switch the workpiece settings may be prolonged. As a result, it may hamper an improvement in efficiency of grinding of the workpiece.

In addition, in the teaching operation, difference in grinding skill among respective workers may cause an error in the position at which the grinding wheel is brought into contact with the workpiece. Depending on the amount of error, the workpiece may not be ground accurately, which may result in a production of a defective product and a significant deterioration of a yield.

The present invention has been made to solve the problems described above, and it is an object thereof to provide a grinding technique capable of shortening the time required to switch workpiece settings and capable of grinding a workpiece with high precision by bringing a grinding wheel into contact with the workpiece accurately.

Means for Solving the Problem

In order to achieve the above object, according to the present invention, a grinding machine includes a grinding wheel configured to grind a workpiece, and a grinding wheel control system configured to move the grinding wheel relative to the workpiece. The grinding machine includes a first control section configured to calculate and set a provisional grinding start position S0' of the grinding wheel relative to a first workpiece, with a center position of a support shaft supporting the grinding wheel being a reference, and based on a diameter ID of the first workpiece before grinding, a diameter WD of the grinding wheel, a grinding completion position S4 on the first workpiece after the grinding, and an actual grinding start position S0 of the grinding wheel relative to each of second and subsequent workpieces before grinding, a second control section configured to position the grinding wheel at the provisional grinding start position S0' that has been set by the first control section, a third control section configured move the grinding wheel relative to the first workpiece from the provisional grinding start position S0' to grind the first workpiece, and a fourth control section configured to fix the actual grinding start position S0 by moving the grinding wheel away from the first workpiece by a distance corresponding to S4, based on a gauge signal from an in-process gauge near the grinding completion position S4. The first control section is configured to set the provisional grinding start position S0' by a calculation, $S0'=ID-WD-S4-S\alpha$, in view of a predetermined allowance $S\alpha$ between the actual grinding start position S0 and the provisional grinding start position S0'.

According to an aspect of the present invention, the in-process gauge is configured to measure the diameter of the first workpiece to detect a grinding condition of the first workpiece. The fourth control section is configured to fix the actual grinding start position S0 by moving the grinding wheel away from the first workpiece by the distance corresponding to S4, based on the gauge signal from the in-process gauge near the grinding completion position S4.

According to as aspect of the present invention, the allowance $S\alpha$ is set in view of an error generated when arranging the grinding wheel to face the first workpiece to at the time of starting the grinding.

According to as aspect of the present invention, when switching between a setting for a grinding of a certain workpiece and a setting for a grinding of a different workpiece, the fourth control section is configured to, in the grinding of the first workpiece at a beginning of the setting, moves the grinding wheel relative to the first workpiece from the provisional grinding start position S0' to grind the first workpiece, and moves the grinding wheel away from the first workpiece by the distance corresponding to S4, based on the gauge signal from the in-process gauge near the grinding completion position S4, to fix the actual grinding start position S0, and in the grinding of each of the second and subsequent workpieces after the switching of the settings, repeat a process of moving the grinding wheel relative to the workpiece from the actual grinding start position S0 to grind the workpiece, and moving the grinding wheel to actual grinding start position S0 based on the gauge signal from the in-process gauge near the grinding completion position S4.

Advantages of Invention

According to the present invention, a teaching operation of bringing the grinding wheel into contact with the workpiece becomes unnecessary, and the workpiece settings can be performed automatically. Therefore, it is possible to reduce the time required to switch the workpiece settings, and to grind the workpiece with high precision by accurately bringing the grinding wheel into contact with the workpiece. Consequently, according to the present invention, the grinding technique capable of reducing a production a defective product and having superior grinding efficiency can be achieved.

EMBODIMENTS OF INVENTION

Hereinafter, a grinding technique according to an embodiment of the present invention will be described with reference to the accompanying drawings.

Figure 1A:
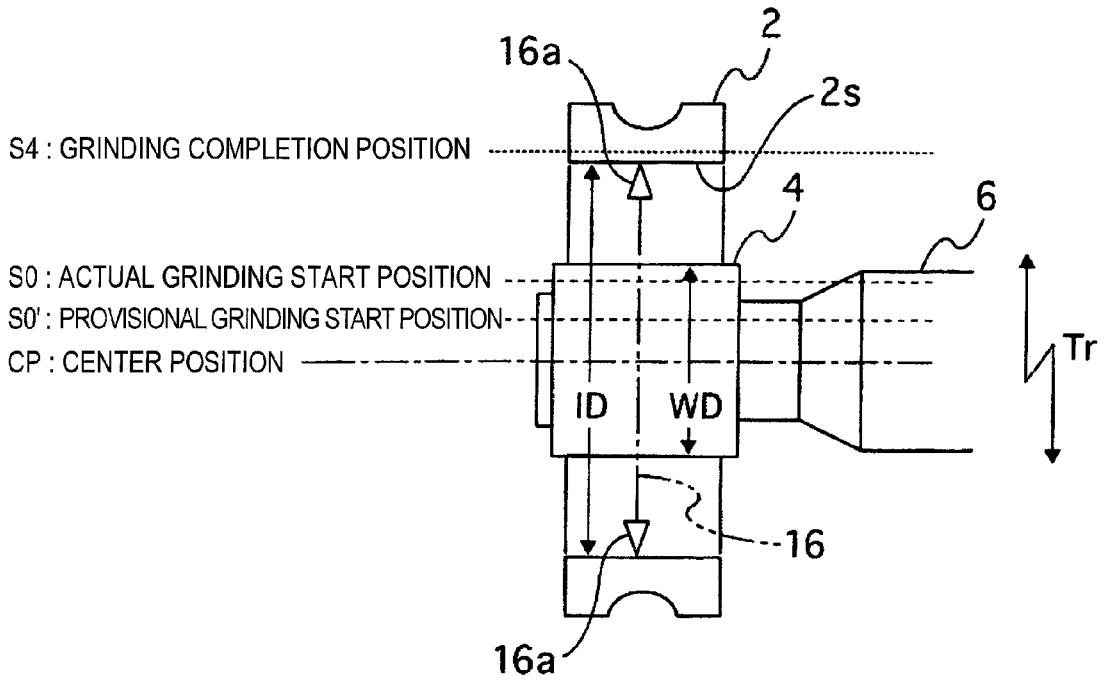
FIG. 1A is a diagram illustrating a positional relationship between a grinding start position and a grinding completion position in a grinding machine according to an embodiment of the present invention.
Figure 2A:
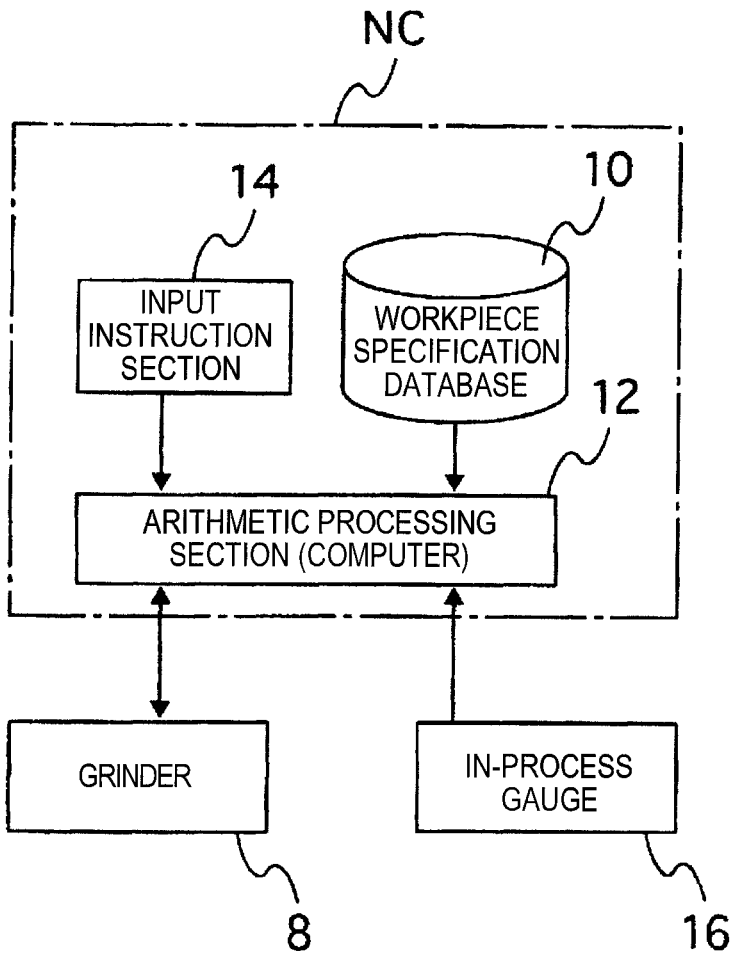
FIG. 2A is a block diagram illustrating a configuration of a grinding wheel control system in a grinding machine according to an embodiment of the present invention.

FIGS. 1A and 2A illustrate a configuration of a grinding machine for implementing a grinding technique of this embodiment. The grinding machine includes a grinding wheel 4 which performs grinding on a workpiece 2, and a grinding wheel control system NC which moves the grinding wheel 4 relative to the workpiece 2. In this instance, the grinding wheel 4 is supported by a support shaft (also called as an infeed shaft or a servo shaft) of a quill type, and the support shaft 6 is incorporated in the grinder 8 which is controlled by the grinding wheel control system NC.

The grinding wheel control system NC includes a workpiece specification database 10 in which specifications required for the grinding of various workpieces 2 are registered in advance, and an arithmetic processing section 12 which executes a given arithmetic processing based on the specifications of the various workpieces registered in the workpiece specification database 10. Examples of the workpiece 2 include an inner ring and an outer ring of a bearing.

The specifications of various workpieces 2 registered in the workpiece specification database 10 is information required for the grinding of the workpiece 2. For example, the information including a diameter (inner diameter) ID of the workpiece 2 before the grinding, and a moving position of the grinding wheel 4 for the grinding (e.g., a grinding feed position such as a high-speed feed completion position S1, a rough feed completion position S2, a finish feed completion position S3, and a fine finish completion position S4) is used as an example of these specifications. In this instance, the high-speed feed completion position S1 means a range in which the grinding wheel 4 comes first into contact with the workpiece 2 at the grinding, in other words, a range of which the grinding wheel 4 does not in contact with the workpiece 2. Each of positions S2, S3, S4 indicates a range in which each grinding feed of the rough feed grinding, the finish feed grinding, and the fine finish feed grinding is performed after the grinding wheel 4 is taught in the workpiece 2 (see FIG. 1B).

A computer (not illustrated) for executing various arithmetic processing required for the grinding based on the above-described specifications is installed in the arithmetic processing section 12. The computer includes a ROM (not illustrated) storing various arithmetic processing programs, a RAM (not illustrated) specifying an operational region for executing the arithmetic processing program, and a CPU (not illustrated) executing the arithmetic processing program in the RAM.

In the arithmetic processing section 12, the above-described arithmetic processing is executed based the specifications of various workpieces registered in the workpiece specification database 10, the grinder 8 is controlled (e.g., feed control or rotation control) based on the arithmetic processing result. Accordingly, the grinding wheel 4 supported by the support shaft 6 can be move relatively to the workpiece 2 to perform the grinding (each grinding feed of the rough feed grinding, the finish feed grinding, and the fine finish feed grinding) on the workpiece 2. In this instance, the support shaft 6 is feed-controlled or rotation-controlled by, for example, an AC servo motor (not illustrated). Therefore, the movement control of the grinding wheel 4 to the above-described grinding feed positions S0, S1, S2, S3, S4.

Specifically, based on the specification data associated with the workpiece 2 matched to a model number which is assigned for every workpiece 2, the arithmetic processing section 12 controls the grinder 8. The model number is input from an input instruction section 14 which is provided in the grinding wheel control system NC. In this instance, the arithmetic processing section 12 detects a rotational displacement and a revolving speed of an output shaft of the AC servo motor by an encoder (rotation detector) (not illustrated), and compares a current position (coordinates) signal and a target position (coordinates) signal to perform a feedback control (feed control and rotation control) on the support shaft 6.

If there is a difference between the current position (coordinates) signal and the target position (coordinates) signal, the arithmetic processing section 12 moves (rotate) the AC servo motor in a direction to decrease the difference from the target position (coordinates) signal. The above procedure is repeated until it reaches finally a target value, or it belongs to an allowable range, thereby performing the movement control of the grinding wheel 4 to the above-described grinding feed positions S0, S1, S2, S3, S4.

Alternatively, for example, the current position information (coordinates) of the AC servo motor can be recorded digitally. The movement of the grinding wheel 4 to the grinding feed positions S0, S1, S2, S3, S4 may be controlled so that the grinding wheel 4 reaches the target value at one time by providing the information with the difference to the target position (coordinates) signal. In this way, it is possible to improve the efficiency of the routine from the switching of the settings of the workpiece 2 to the grinding.

The grinding condition of the workpiece 2 is always detected by an in-process gauge 16. When the diameter (inner diameter) ID of the workpiece 2 becomes a preset value (e.g., a desired finish dimension), a gauge signal indicating the diameter is output from the in-process gauge 16 to the grinding wheel control system NC (specifically, the arithmetic processing section 12).

The in-process gauge 16 is provided with a pair of opposite sensing pins 16*a*, and the grinding condition of the workpiece 2 can be always detected by setting the pair of sensing pins 16*a* onto a portion to be ground of the workpiece 2. In this instance, so as to cancel an effect of eccentricity of the workpiece 2 during the grinding, it is preferable to set one pair of sensing pins 16*a* to measure the diameter (inner diameter) ID of the workpiece 2.

Further, when the gauge signal is output from the in-process gauge 16 (in other words, when the gauge signal from the in-process gauge 16 is input to the arithmetic processing section 12), the arithmetic processing section 12 controls the grinder 8 based on the gauge signal. In this way, the moving condition of the grinding wheel 4 with respect to the workpiece 2 (specifically, grinding feed including the rough feed grinding, the finish feed grinding, and the fine finish feed grinding) is switched (see FIG. 1B).

For example, when the gauge signal 1 is input during the rough feed, the arithmetic processing section 12 switches the following moving condition (grinding feed) of the grinding wheel 4 to be the finish feed. Further, for example, when the gauge signal 2 is input during the finish feed, the arithmetic processing section 12 switches the following moving condition (grinding feed) of the grinding wheel 4 to be the fine finish feed. For example, when the gauge signal 3 is input during the fine finish feed, the arithmetic processing section 12 feeds the grinding wheel 4 back to the actual grinding start position S0.

In the grinding technique of this embodiment, the operational flow will be described based on detailed configuration. In the operational flow, as one example of the workpiece 2, the inner ring is used. Further, the portion which is subjected to the grinding is generally an inner diameter surface or an outer diameter surface of the workpiece 2, for example, but an inner diameter surface 2*s* of the workpiece (inner ring) 2 is subjected to the grinding as one example.

Further, in the operational flow, in particular, the switching is performed between the setting for the grinding on one workpiece 2 and the setting for the grinding on another workpiece 2. That is, in the operational flow, the settings are switched among workpieces (inner rings) 2 having different model numbers. Herein, the grinding process before the switching of the settings, that is, an inner diameter surface 2*s* of the first workpiece (inner ring) 2, will be described. In this instance, the pair of sensing pins 16*a* of the in-process gauge 16 are set to measure the inner diameter of the workpiece 2 (inner ring), that is, the diameter ID of the inner diameter surface 2*s*.

Figure 2B:
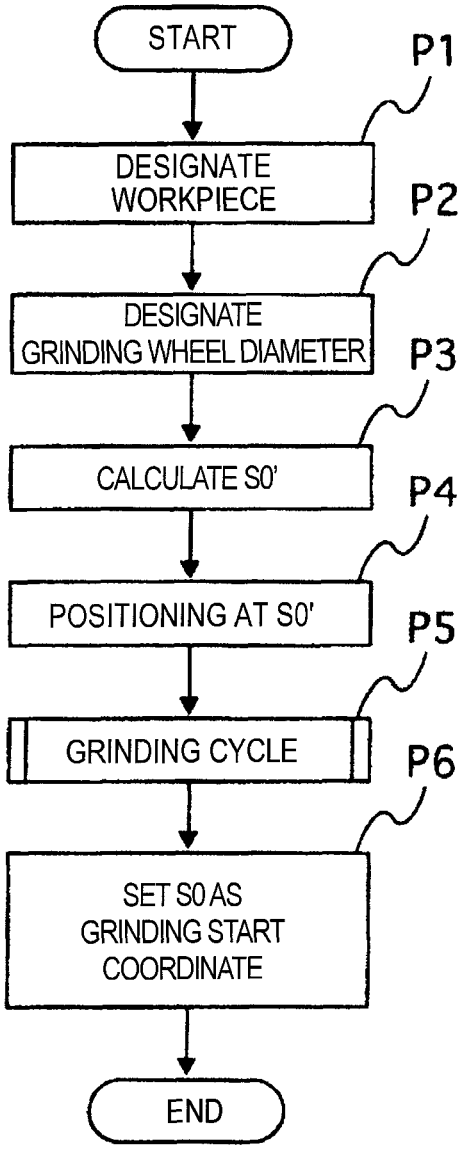
FIG. 2B is flowchart illustrating an initial grinding process at the time of switching workpiece settings.

As illustrated in FIGS. 2A and 2B, when a new model number data is input from the input instruction section 14 to designate the first workpiece (inner ring) 2 (P1 in FIG. 2B), the diameter (inner diameter) ID of the designated workpiece (inner ring) 2 is determined. Then, the diameter WD of the grinding wheel 4 is input and designated from the input instruction section 14 (P2 in FIG. 2B). Accordingly, the grinding wheel control system NC sets the provisional grinding start position S0', at which the grinding wheel 4 is to be positioned relative to the inner diameter surface 2*s* of the workpiece 2, by calculation (P3 in FIG. 2B).

The calculation of the provisional grinding start position S0' is performed based on the specifications of the first workpiece (inner ring) 2 registered in the workpiece specification database 10 by the arithmetic processing section 12. That is, the provisional grinding start position S0' of the grinding wheel 4 relative to the inner diameter surface 2*s* of the first workpiece (inner ring) 2 is calculated, with reference to the center position CP of the support shaft 6 supporting the grinding wheel 4, and from the diameter (inner diameter) ID of the first workpiece (inner ring) 2 before it is ground, the diameter WD of the grinding wheel, the fine finish completion position S4 on the workpiece (inner ring) 2 immediately after the grinding, and the actual grinding start position S0 of the grinding wheel 4 relative to each of second and subsequent workpieces (inner rings) 2 before grinding.

Further, the center position CP of the support shaft 6 supporting the grinding wheel 4 is stored in the arithmetic processing section 12 in advance as information to control the AC servo motor for feed control of the support shaft 6. The center position CP of the support shaft 6 supporting the grinding wheel 4 is a position in which a rotational center line of a backing plate (not illustrated) rotatably supporting the workpiece (inner ring) 2 and a center line of the grinding wheel 4.

In this embodiment, the provisional grinding start position S0' is set by the arithmetic processing section 12 based on the calculation which will be described below, in view of a predetermined allowance Sα between the actual grinding start position S0 and the provisional grinding start position S0'. The allowance Sα is set in view of an amount of error which may be generated when arranging the grinding wheel 4 to face the inner diameter surface 2*s* of the first workpiece (inner ring) 2 at the time of starting the grinding (see FIG. 1A). In this instance, for example, the following 6 factors may be the errors that are taken into account as the allowance Sα. The following factors are merely an example, and the technical scope of the present invention is not limited thereto. Other factors may be added as the error amount of the allowance Sα.

(1) In a case in which the workpiece 2 is an outer ring, a positional error of a backing plate (not illustrated) rotatably supporting the workpiece 2.

(2) In a case in which the workpiece 2 is the outer ring, a dimensional error of an outer diameter of an outer ring groove.

(3) Measurement error of the diameter WD of the grinding wheel 4.

(4) Error due to an inclination (bending amount) of a quill type support shaft 6.

(5) In a case in which the workpiece 2 is held by a pair of shoes, an error due to wearing of the shoes.

(6) In a case in which the workpiece 2 is held by a pair of shoes, an error in polishing precision of the shoes.

Specifically, the provisional grinding start position S0' is set to a position relatively largely spaced from the inner diameter surface 2*s* of the first workpiece (inner ring) 2 before the grinding by the arithmetic processing section 12. The arithmetic processing section 12 controls the grinder 8 based on the set data to perform the feed control and the rotation control on the support shaft 6, so that the stop position of the grinding wheel 4 is controlled to be at the provisional grinding start position S0'. Thus, the grinding wheel 4 is positioned at the provisional grinding start position S0' (P4 in FIG. 2B).

Next, the arithmetic processing section 12 performs the grinding on the inner diameter surface 2*s* of the first workpiece (inner ring) 2 while relatively moving the grinding wheel 4 with respect to the first workpiece (inner ring) 2 from the provisional grinding start position S0' (P5 in FIG. 2B). Specifically, the grinding on the first workpiece (inner ring) 2 is performed according to a grinding cycle illustrated in FIG. 2C.

Figure 1B:
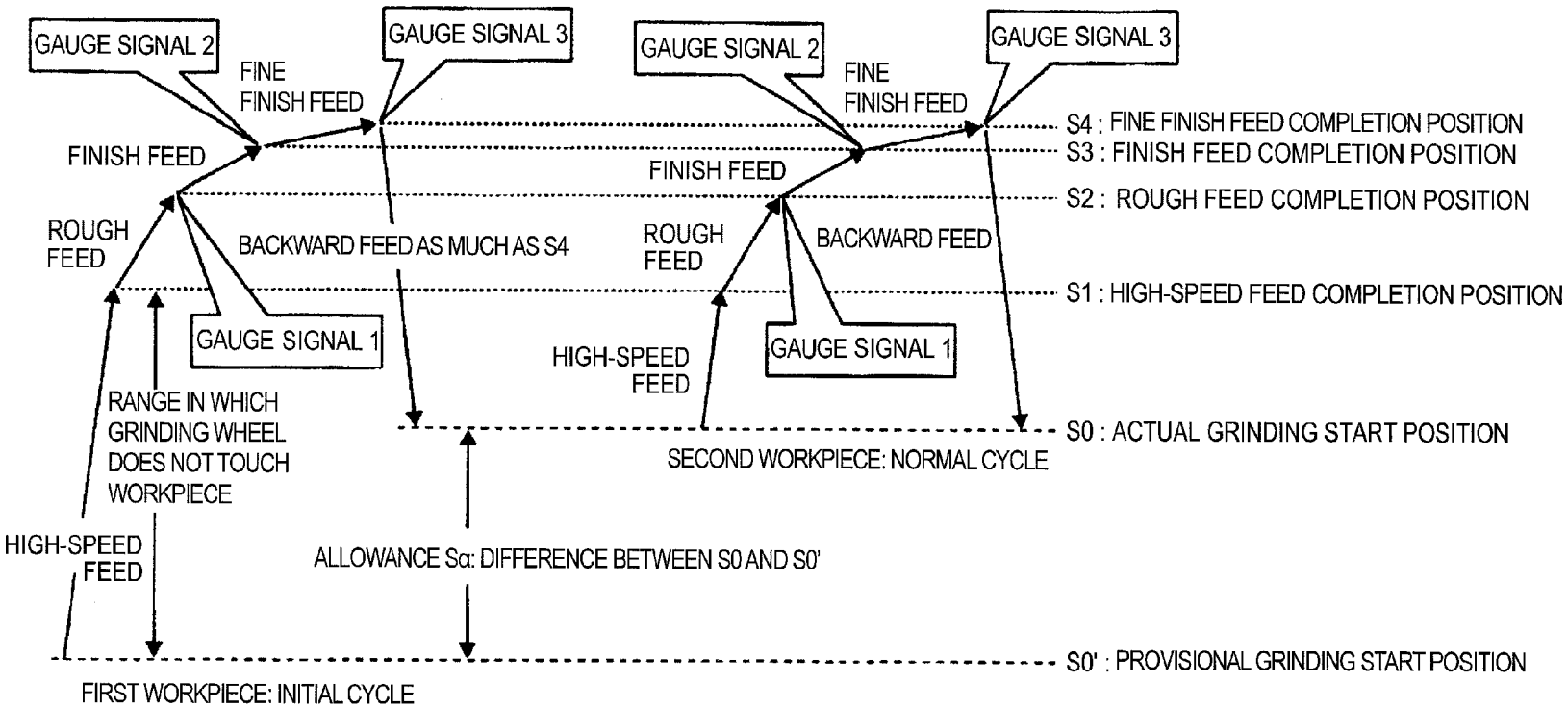
FIG. 1B is a diagram illustrating an example of a grinding cycle for implementing a grinding method according to an embodiment of the present invention.
Figure 2C:
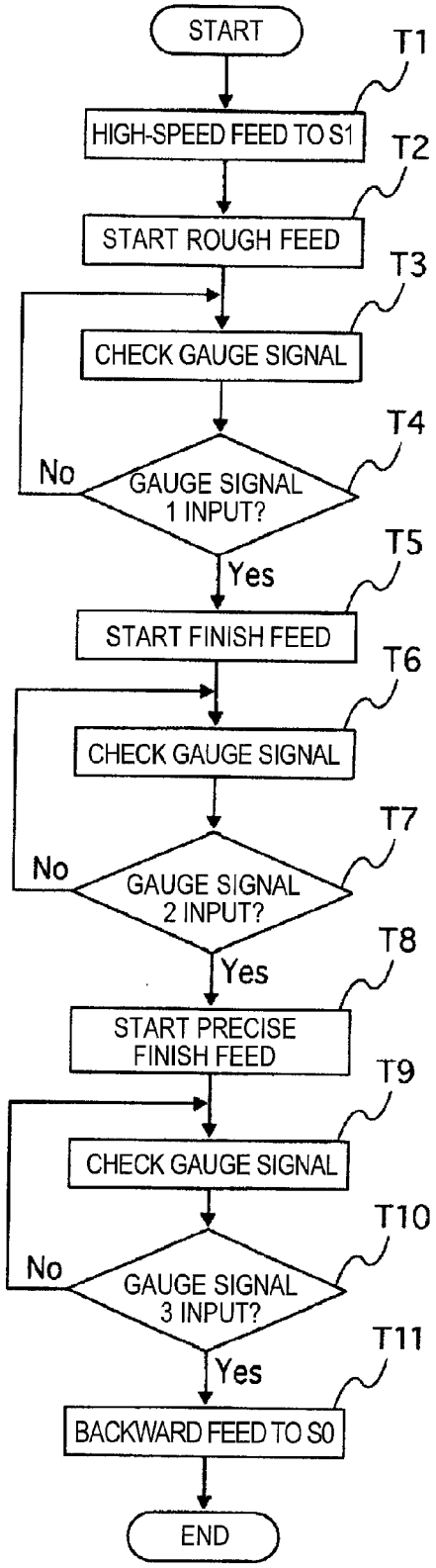
FIG. 2C is a flowchart illustrating a subroutine of the grinding cycle.

First, as illustrated in FIGS. 1B and 2C, the arithmetic processing section 12 moves (high-speed feed) the grinding wheel 4 from the provisional grinding start position S0' to the high-speed feed completion position S1 (T1 in FIG. 2C). Next, the arithmetic processing section 12 controls the grinder 8 to switch the moving condition of the grinding wheel 4 from the high-speed feed to the rough feed state. After that, in the state in which the grinding wheel 4 is taught in the inner diameter surface 2*s* of the first workpiece (inner ring) 2, the rough feed grinding starts while the grinding wheel 4 is moved (rough feed) (T2 in FIG. 2C).

While the rough feed grinding is performed, the grinding condition of the inner diameter surface 2*s* of the first workpiece (inner ring) 2 is always detected by the pair of sensing pins 16*a* of the in-process gauge 16 (T3 in FIG. 2C). Near the rough feed completion position S2, the gauge signal 1 from the in-process gauge 16 is output to the arithmetic processing section 12.

The arithmetic processing section 12 controls the grinder 8 based on the input gauge signal 1 (T4 in FIG. 2C) to switch the moving condition of the grinding wheel 4 with respect to the first workpiece (inner ring) 2 from the rough feed grinding to the finish feed grinding. Accordingly, the finish feed grinding starts (T5 in FIG. 2C).

While the finish feed grinding is performed, the grinding condition of the inner diameter surface 2*s* of the first workpiece (inner ring) 2 is always detected by the pair of sensing pins 16*a* of the in-process gauge 16 (T6 in FIG. 2C). Near the finish feed completion position S3, the gauge signal 2 from the in-process gauge 16 is output to the arithmetic processing section 12.

The arithmetic processing section 12 controls the grinder 8 based on the input gauge signal 2 (T7 in FIG. 2C) to switch the moving condition of the grinding wheel 4 with respect to the first workpiece (inner ring) 2 from the finish feed grinding to the fine finish feed grinding. Accordingly, the fine finish feed grinding starts (T8 in FIG. 2C).

While the fine finish feed grinding is performed, the grinding condition of the inner diameter surface 2*s* of the first workpiece (inner ring) 2 is always detected by the pair of sensing pins 16*a* of the in-process gauge 16 (T9 in FIG. 2C). Near the fine finish feed completion position S4, the gauge signal 3 from the in-process gauge 16 is output to the arithmetic processing section 12.

The arithmetic processing section 12 controls the grinder 8 based on the input gauge signal 3 (T10 in FIG. 2C) to feed the grinding wheel 4 back in a direction spaced apart from the inner diameter surface 2*s* of the first workpiece (inner ring) 2. The backward feeding amount is an amount corresponding to S4, and the grinding wheel 4 is spaced apart from the inner diameter surface 2*s* of the first workpiece (inner ring) 2 by this backward feeding amount (11 in FIG. 2C).

Therefore, in the grinding process of the original set illustrated in FIG. 2B, the actual grinding start position S0 is fixed by the arithmetic processing section 12 (P6 in FIG. 2B). The above-described fine finish feed grinding may be omitted by using the effect quill bending. In this case also, the backward feeding control of the grinding wheel 4 is performed based on the input of the gauge signal 3. In this case, the input of the gauge signal 2 is omitted. The backward feeding amount is an amount corresponding to S4, and the grinding wheel 4 is moved away from the inner diameter surface 2*s* of the first workpiece (inner ring) 2 by this back word feeding amount.

Based on the fixed actual grinding start position S0, and in view of the predetermined allowance Sα described above, the arithmetic processing section 12 sets the provisional grinding start position S0' by the following equation:

$$S0'=ID-WD-S4-S\alpha$$

In this way, according to the grinding technique of this embodiment, the grinding can be performed on the inner diameter surface 2*s* of the first workpiece (inner ring) 2 while the grinding wheel 4 is moved relative to the inner diameter surface 2*s* of the first workpiece (inner ring) 2 at the beginning of the setting from the provisional grinding start position S0'. Then, the actual grinding start position S0 is fixed by moving the grinding wheel 4 away from the inner diameter surface 2*s* of the first workpiece (inner ring) 2 as much as S4, based on the gauge signal 3 from the in-process gauge 16, near the grinding completion position S4.

When grinding the inner diameter surface 2*s* of each of second and subsequent workpieces (inner rings) 2 after the settings have been switched, the grinding is performed on the inner diameter surface 2*s* of the workpiece (inner ring) 2 while the grinding wheel 4 is moved relative to the inner diameter surface 2*s* of the workpiece (inner ring) 2 from the actual grinding start position S0. The grinding process of moving the grinding wheel 4 to the actual grinding start position S0, based on the gauge signal 3 from the in-process gauge 16, near the grinding completion position S4 is again repeated.

There is an individual difference in the outer diameter of the workpiece 2, and there is also light variation in the position at which the workpiece 2 is fixed to the grinding section. Due to this, the position of the grinding wheel at the time when the gauge signal is output from the in-process gauge 16 varies slightly for each workpiece 2. The gauge signal may be output when the grinding wheel has not yet reached each of the positions S2, S3, S4, or has slightly passed each of the positions S2, S3, S4. In the present description, the output of the gauge signal in the process of moving the grinding wheel toward the positions S2, S3, S4 is described as the output of the gauge signal near each of the positions S2, S3, S4.

According to this embodiment, since the above-described teaching operation (contacting operation) is not necessary, the setting of the positional relationship between the workpiece (inner ring) 2 and the grinding wheel 4 can be automatically performed. Therefore, it is possible to reduce the time required to switch the settings of the workpiece (inner ring) 2, thereby improving the efficiency of the grinding of the workpiece (inner ring) 2.

In this instance, even if there are relative merits in grinding skills of workers working on switching of the settings, it is possible to accurately teach the grinding wheel 4 in the workpiece (inner ring) 2. Therefore, the workpiece (inner ring) 2 is ground with high precision, and generation of a defective product can be decreased. As a result, a yield can be remarkably improved.

The present invention is not limited to the embodiment described above, and various changes can be made to implement the invention within the scope as defined in the claims. In the embodiment described above, the inner ring has been described as the workpiece 2, but the present invention is not limited thereto. The technical concept according to the embodiment described above can of course be applied to a grinding of a radially inner surface (e.g., a raceway groove of the outer ring) of the outer ring as the workpiece 2.

The present application is based on Japanese Patent Application No. 2011-148538 filed on Jul. 4, 2011, the content of which is incorporated herein by reference.

EXPLANATION OF REFERENCE SIGNS

2: workpiece (inner ring, outer ring)
4: grinding wheel
6: support shaft (infeed shaft, servo shaft)
CP: center position (center) of support shaft
ID: diameter (inner diameter) of workpiece before grinding
WD: diameter of grinding wheel
S4: grinding completion position
S0: actual grinding start position
S0': provisional grinding start position
Sα: allowance

The invention claimed is:

1. A grinding machine comprising a grinding wheel configured to grind a workpiece, and a grinding wheel control system configured to move the grinding wheel relative to the workpiece, the grinding machine comprising:

a first control section configured to calculate and set a provisional grinding start position S0' of the grinding wheel relative to a first workpiece, with a center position of a support shaft supporting the grinding wheel being a reference, and based on a diameter ID of the first workpiece before grinding, a diameter WD of the grinding wheel, a grinding completion position S4 on the first workpiece after the grinding, and an actual grinding start position S0 of the grinding wheel relative to each of second and subsequent workpieces before grinding;

a second control section configured to position the grinding wheel at the provisional grinding start position S0' that has been set by the first control section;

a third control section configured move the grinding wheel relative to the first workpiece from the provisional grinding start position S0' to grind the first workpiece; and a fourth control section configured to fix the actual grinding start position S0 by moving the grinding wheel away from the first workpiece by a distance corresponding to S4, based on a gauge signal from an in-process gauge near the grinding completion position S4, wherein the first control section is configured to set the provisional grinding start position S0' by a calculation, $$S0'=ID-WD-S4-S\alpha$$

in view of a predetermined allowance Sα between the actual grinding start position S0 and the provisional grinding start position S0'.

2. The grinding machine according to claim 1, wherein the in-process gauge is configured to measure the diameter of the first workpiece to detect a grinding condition of the first workpiece, and the fourth control section is configured to fix the actual grinding start position S0 by moving the grinding wheel away from the first workpiece by the distance corresponding to S4, based on the gauge signal from the in-process gauge near the grinding completion position S4.

3. The grinding machine according to claim 1, wherein the allowance Sα is set in view of an error generated when arranging the grinding wheel to face the first workpiece to at the time of starting the grinding.

4. The grinding machine according to claim 1, wherein, when switching between a setting for a grinding of a certain workpiece and a setting for a grinding of a different workpiece, the fourth control section is configured to, in the grinding of the first workpiece at a beginning of the setting, moves the grinding wheel relative to the first workpiece from the provisional grinding start position S0' to grind the first workpiece, and moves the grinding wheel away from the first workpiece by the distance corresponding to S4, based on the gauge signal from the in-process gauge near the grinding completion position S4, to fix the actual grinding start position S0, and in the grinding of each of the second and subsequent workpieces after the switching of the settings, repeat a process of moving the grinding wheel relative to the workpiece from the actual grinding start position S0 to grind the workpiece, and moving the grinding wheel to actual grinding start position S0 based on the gauge signal from the in-process gauge near the grinding completion position S4.

5. A grinding method using a grinding machine including a grinding wheel configured to grind a workpiece and a grinding wheel control system configured to move the grinding wheel relative to the workpiece, the grinding method comprising:

a first step of calculating and setting a provisional grinding start position S0' of the grinding wheel relative to a first workpiece, with a center position of a support shaft supporting the grinding wheel being a reference, and based on a diameter ID of the first workpiece before grinding, a diameter WD of the grinding wheel, a grinding completion position S4 on the first workpiece after the grinding, and an actual grinding start position S0 of the grinding wheel relative to each of second and subsequent workpieces before grinding;

a second step of positioning the grinding wheel at the provisional grinding start position S0' that has been set in the first process;

a third step of moving the grinding wheel relative to the first workpiece from the provisional grinding start position S0' to grind the first workpiece; and a fourth step of fixing the actual grinding start position S0 by moving the grinding wheel away from the first workpiece by a distance corresponding to S4 near the grinding completion position S4, wherein in the first step, the provisional grinding start position S0' is set by a calculation, $$S0'=ID-WD-S4-S\alpha$$

in view of a predetermined allowance Sα between the actual grinding start position S0 and the provisional grinding start position S0'.

6. The grinding method according to claim 5, wherein the diameter of the first workpiece is measured by an in-process gauge to detect a grinding condition of the first workpiece, and in the fourth step, the actual grinding start position S0 is fixed by moving the grinding wheel away from the first workpiece by the distance corresponding to S4, based on a gauge signal from the in-process gauge near the grinding completion position S4.

7. The grinding method according to claim 5, wherein the allowance Sα is set in view of an error generated when arranging the grinding wheel to face the first workpiece at the time of starting the grinding.

8. The grinding method according to claim 6, wherein, when switching between a setting for a grinding of a certain workpiece and a setting for a grinding of a different workpiece, in the fourth step, in the grinding of the first workpiece at a beginning of the setting, the grinding wheel is moved relative to the first workpiece from the provisional grinding start position S0' to grind the first workpiece, and the grinding wheel is moved away from the first workpiece by the distance corresponding to S4, based on the gauge signal from the in-process gauge near the grinding completion position S4, to fix the actual grinding start position S0, and in the grinding of each of the second and subsequent workpieces after the switching of the settings, a process of moving the grinding wheel relative to the workpiece from the actual grinding start position S0 to grind the workpiece, and moving the grinding wheel to actual grinding start position S0 based on the gauge signal from the in-process gauge near the grinding completion position S4 is repeated.

* * * * *